US008057180B1

(12) United States Patent
Liang

(10) Patent No.: US 8,057,180 B1
(45) Date of Patent: Nov. 15, 2011

(54) SHAPED FILM COOLING HOLE FOR TURBINE AIRFOIL

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 522 days.

(21) Appl. No.: 12/266,958

(22) Filed: Nov. 7, 2008

(51) Int. Cl.
*F01D 5/18* (2006.01)

(52) U.S. Cl. ..... 416/97 R

(58) Field of Classification Search ..... 416/97 R, 416/97 A

See application file for complete search history.

(56) References Cited

U.S. PATENT DOCUMENTS 4,653,983 A 3/1987 Vehr
4,684,323 A 8/1987 Field
4,738,588 A * 4/1988 Field ..... 416/97 R
5,382,133 A 1/1995 Moore et al.
6,183,199 B1 2/2001 Beeck et al.
6,869,268 B2 3/2005 Liang
6,918,742 B2 7/2005 Liang

* cited by examiner

*Primary Examiner* — Chandra Chaudhari
(74) *Attorney, Agent, or Firm* — John Ryznic

(57) ABSTRACT

A film cooling hole for a turbine airfoil used in a gas turbine engine, where the film cooling hole includes a metering inlet section of constant diameter cross section and a diffusion section having side walls with multiple expansion. The two side walls have an expansion of around 10 degrees and also slant inwards or toward the downstream side wall of from 10 to 45 degrees to provide the addition expansion. The downstream wall also expands at around 10 degrees. For a compound shaped film hole, the multiple expansions are 10 degrees in the downstream direction and 0 to 5 degrees in the radial outward direction. The side wall in the radial expansion direction will at a convergent angle of 10 to 45 degrees. In the radial inward direction, the expansion angle is from 10 to 20 degrees with a convergent side wall angle of from 10 to 45 degrees.

13 Claims, 3 Drawing Sheets

SHAPED FILM COOLING HOLE FOR TURBINE AIRFOIL

FEDERAL RESEARCH STATEMENT

None.

CROSS-REFERENCE TO RELATED APPLICATIONS

None.

BACKGROUND OF THE INVENTION

1. Field of the Invention

The present invention relates generally to a gas turbine engine, and more specifically to a film cooling hole for a turbine airfoil.

2. Description of the Related Art Including Information Disclosed Under 37 CFR 1.97 and 1.98

Airfoils used in a gas turbine engine, such as rotor blades and stator vanes (guide nozzles), require film cooling of the external surface where the hottest gas flow temperatures are found. The airfoil leading edge region is exposed to the highest gas flow temperature and therefore film cooling holes are used here. Film cooling holes discharge pressurized cooling air onto the airfoil surface as a layer that forms a blanket to protect the metal surface from the hot gas flow. The prior art is full of complex film hole shapes that are designed to maximize the film coverage on the airfoil surface while minimizing loses.

Film cooling holes with large length to diameter ratio are frequently used in the leading edge region to provide both internal convection cooling and external film cooling for the airfoil. For a laser or EDM formed cooling hole, the typical length to diameter is less than 12 and the film cooling hole angle is usually no less than 20 degrees relative to the airfoil's leading edge surface. FIGS. 1 and 2 show a prior art film cooling hole with a large length to diameter (L/D) ratio as discloses in U.S. Pat. No. 6,869,268 B2 issued to Liang on Mar. 22, 2005 and entitled COMBUSTION TURBINE WITH AIRFOIL HAVING ENHANCED LEADING EDGE DIFFUSION HOLES AND RELATED METHODS. In order to attain the same film hole breakout length or film coverage shown in FIG. 2, the straight circular showerhead hole in FIG. 1 has to be at around 14 degrees relative to the airfoil leading edge surface. This also results in a length to diameter ration of near 14. Both the film cooling hole angle and L/D exceed current manufacturing capability.

FIG. 2 shows a one dimension diffusion showerhead film cooling hole design which reduces the shallow angle required by the straight hole and changes the associated L/D ratio to a more producible level. This film cooling hole includes a constant diameter section at the entrance region of the hole that provides cooling flow metering capability, and a one dimension diffusion section with less than 10 degrees expansion in the airfoil radial inboard direction. As a result of this design, a large film cooling hole breakout is achieved and the airfoil leading edge film cooling coverage and film effectiveness level is increased over the FIG. 1 straight film cooling hole.

For an airfoil main body film cooling, a two dimensional compound shaped film hole as well as a two dimensional shaped film cooling hole with curved expansion is utilized to enhance film coverage and to minimize the radial over-expansion when these cooling holes are used in conjunction with a compound angle. U.S. Pat. No. 4,653,983 issued to Vehr on Mar. 31, 1987 and entitled CROSS-FLOW FILM COOLING PASSAGE and U.S. Pat. No. 5,382,133 issued to Moore et al on Jan. 17, 1995 and entitled HIGH COVERAGE SHAPED DIFFUSER FILM HOLE FOR THIN WALLS both disclose this type of film cooling hole.

A three dimensional diffusion hole in the axial or small compound angle and variety of expansion shape was also utilized in an airfoil cooling design for further enhancement of the film cooling capability. U.S. Pat. No. 4,684,323 issued to Field on Aug. 4, 1987 and entitled FILM COOLING PASSAGES WITH CURVED CORNERS and U.S. Pat. No. 6,183,199 B1 issued to Beeck et al on Feb. 6, 2001 and entitled COOLING-AIR BORE show this type of film hole.

Another improvement over the prior art three dimensional film hole is disclosed in U.S. Pat. No. 6,918,742 B2 issued to Liang on Jul. 19, 2005 and entitled COMBUSTION TURBINE WITH AIRFOIL HAVING MULTI-SECTION DIFFUSION COOLING HOLES AND METHODS OF MAKING SAME. This multiple diffusion compounded film cooling hole starts with a constant diameter cross section at the entrance region to provide for a cooling flow metering capability. The constant diameter metering section is followed by a 3 to 5 degree expansion in the radial outward direction and a combination of a 3 to 5 degree followed by a 10 degree multiple expansions in the downstream and radial inboard direction of the film hole. There is no expansion for the film hole on the upstream side wall where the film cooling hole is in contact with the hot gas flow.

U.S. Pat. No. 4,653,983 issued to Vehr on Mar. 31, 1987 and entitled CROSS FLOW FILM COOLING PASSAGE discloses a regular shaped film cooling hole of the prior art with the film ejection stream located above the airfoil surface in which vortices form underneath the film cooling discharge from the hole. The film cooling hole is the standard 10-10-10 expansion file hole where the two sides and the bottom of downstream side of the hole all have degrees of expansion. The film flow will penetrate into the main stream and then reattach to the airfoil surface at a distance of around 2 times the film hole diameter. Thus, hot gas injection into the space below the film injection location and subsequently a pair of vortices is formed under the film flow. As a result of the shear mixing, the film effectiveness is reduced. The film layer of cooling air reattaches to the airfoil surface downstream from the vortices that are formed.

BRIEF SUMMARY OF THE INVENTION

It is an object of the present invention to provide for a turbine airfoil with a film cooling hole that will reduce the metal temperature of the airfoil over that of the cited prior art references.

It is another object of the present invention to provide for a film cooling hole that will improve the film cooling effectiveness of the turbine airfoil over the cited prior art references.

The film cooling hole of the present invention includes an inlet section having a constant diameter to provide metering of the cooling air flow, and an outlet section that includes multiple expansions along the two side walls and the downstream wall of the film hole. The two side walls have the expansion of around 10 degrees but also have slanted sidewalls in which the width at the top end of the film hole is less than the width at the bottom end of the film hole. The two side walls are slanted downward toward the bottom of the film hole or the downstream wall of the film hole. The slanted side walls have a slant of from around 10 degrees to around 45 degrees to form a trapezoid shaped diffuser with a smaller open on the hot side next to the mainstream and wider open next to the blade surface.

The same film cooling hole with multiple expansion with slanted side walls is sued in a compound shaped film cooling hole with the two side walls having multiple expansion of around 10 degrees, and 0 to 5 degrees in the radial outward direction. The side walls in the radial expansion direction will be at the convergent angle of 10 to 45 degrees. The cooling hole in the radial inward direction will have an expansion angle in the range of 10 to 20 degrees and with a convergent side wall angle of 10 to 45 degrees.

DETAILED DESCRIPTION OF THE INVENTION

The film cooling hole of the present invention is disclosed for use in a turbine airfoil, such as a rotor blade or a stator vane, in order to provide film cooling for the airfoil surface. However, the film cooling hole can also be used for film cooling of other turbine parts such as the combustor liner, or other parts that require film cooling for protection against a hot gas flow over the surface outside of the gas turbine engine field. The film cooling hole of the present invention is intended for use in the hottest areas of the airfoil which is the leading edge of the airfoil.

Figure 3:
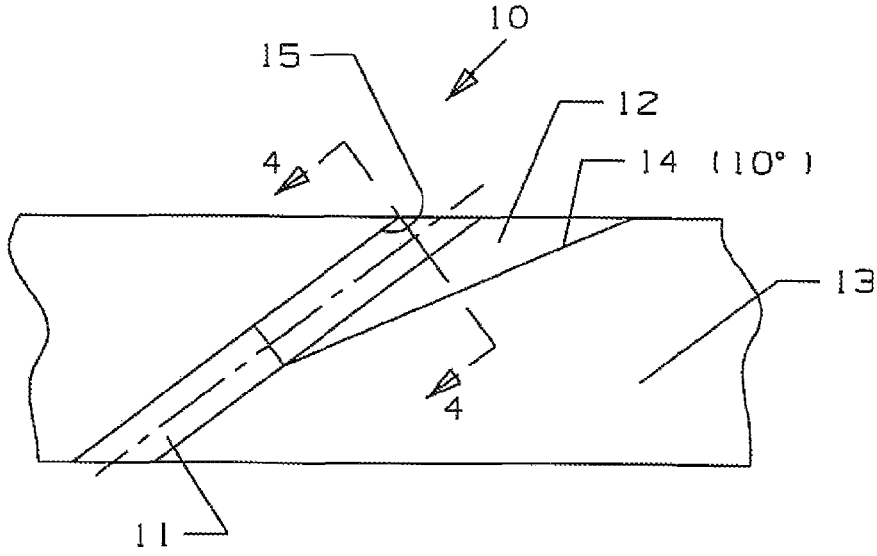
FIG. 3 shows a cross section side view of the film cooling hole of the present invention.

FIG. 3 shows a first embodiment of the shaped film cooling hole of the present invention in which the film hole 10 includes a constant diameter inlet section 11 that functions as a metering section followed by a diffusion section 12 located immediately downstream in the cooling air flow direction from the metering section 11. The film hole 10 is formed within the airfoil wall 13. The diffusion section 12 includes a downstream wall 14 and an upstream wall 15 where the upstream wall 14 provides no diffusion since it is parallel to the upper wall surface of the rounded metering section 11 and the axis of the metering inlet section 11. The downstream wall 14 is slanted to produce a diffusion of around 10 degrees.

Figure 1:
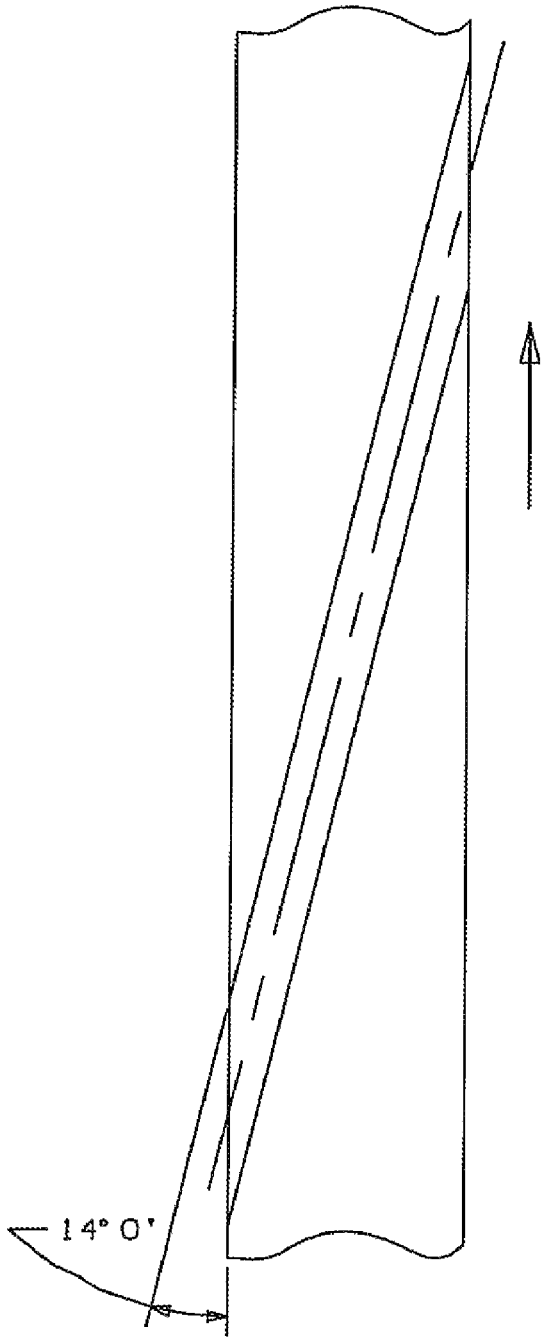
Fig 1 Prior Art
FIG. 1 shows a cross section view of a prior art film cooling hole with a straight hole passing through the wall.
Figure 2:
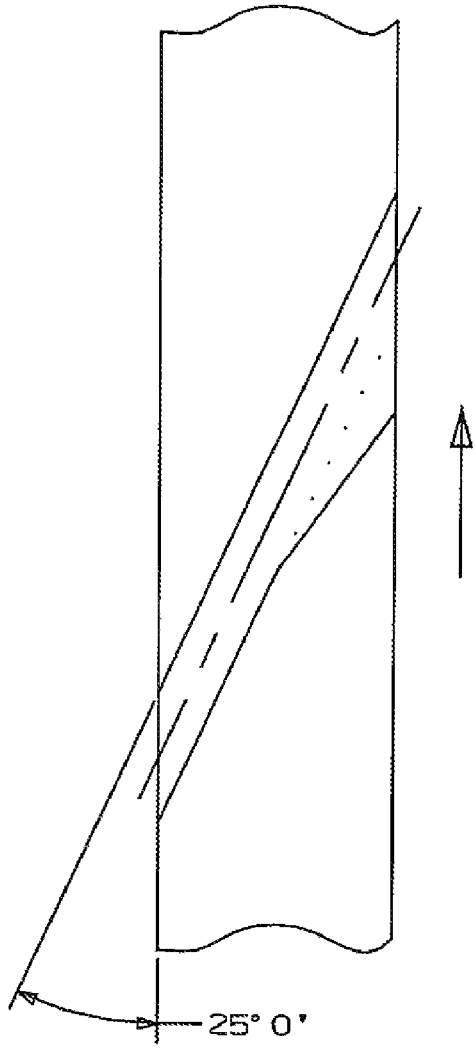
Fig 2 Prior Art
FIG. 2 shows a cross section view of a prior art film cooling hole with an expansion on the downstream side wall surface.
Figure 4:
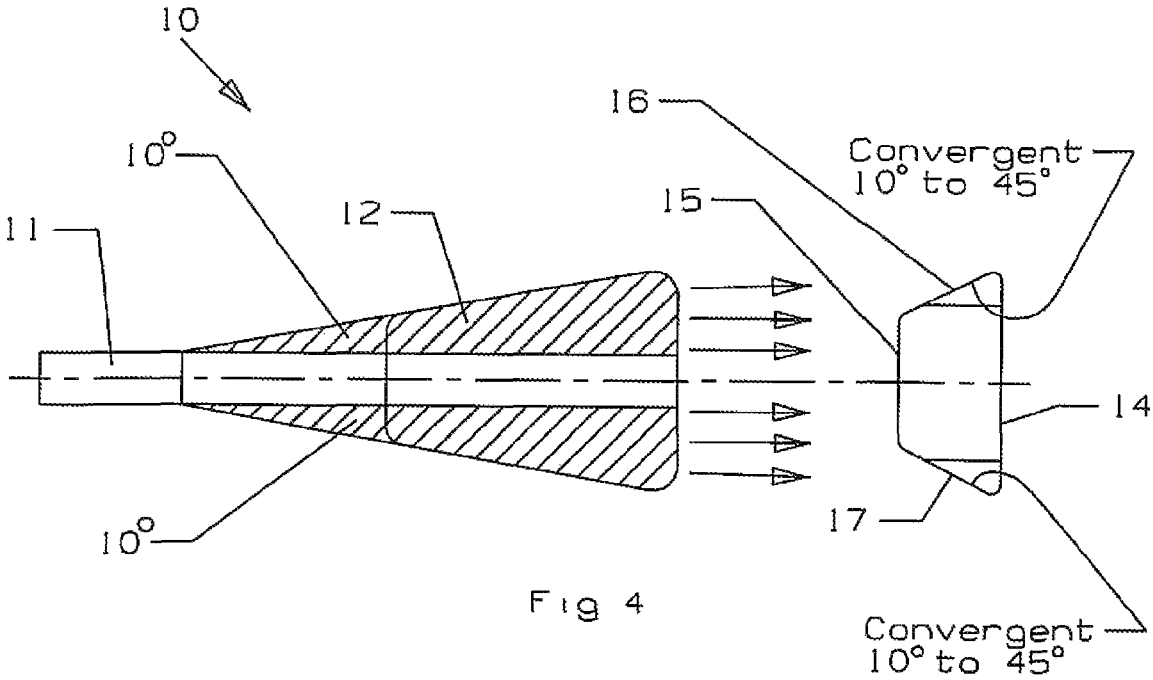
FIG. 4 shows a cross section top view of the film cooling hole of FIG. 3.

The main difference between the applicant's invention and the prior art film holes is the two side walls that form the diffusion section 12. The two side walls provide a diffusion of around 10 degrees but also have an additional slant in the direction facing the downstream wall 14 such that the bottom wall or downstream wall surface is wider than the top wall or upstream wall surface of the diffusion section 12. FIG. 4 shows a cross section view from the top of the film hole with the metering section 11 and the diffusion section 12, and on the right side is a view of the hole opening onto the airfoil surface in which the top or upstream wall 15 has a width less than the bottom or downstream wall 14 because of the slanted side walls 16 and 17 of the diffusion section. The two side walls 16 and 17 can have a slant of from around 10 degrees to around 45 degrees. The diffusion section is generally symmetric in a plane along the central axis of the hole.

Figure 5:
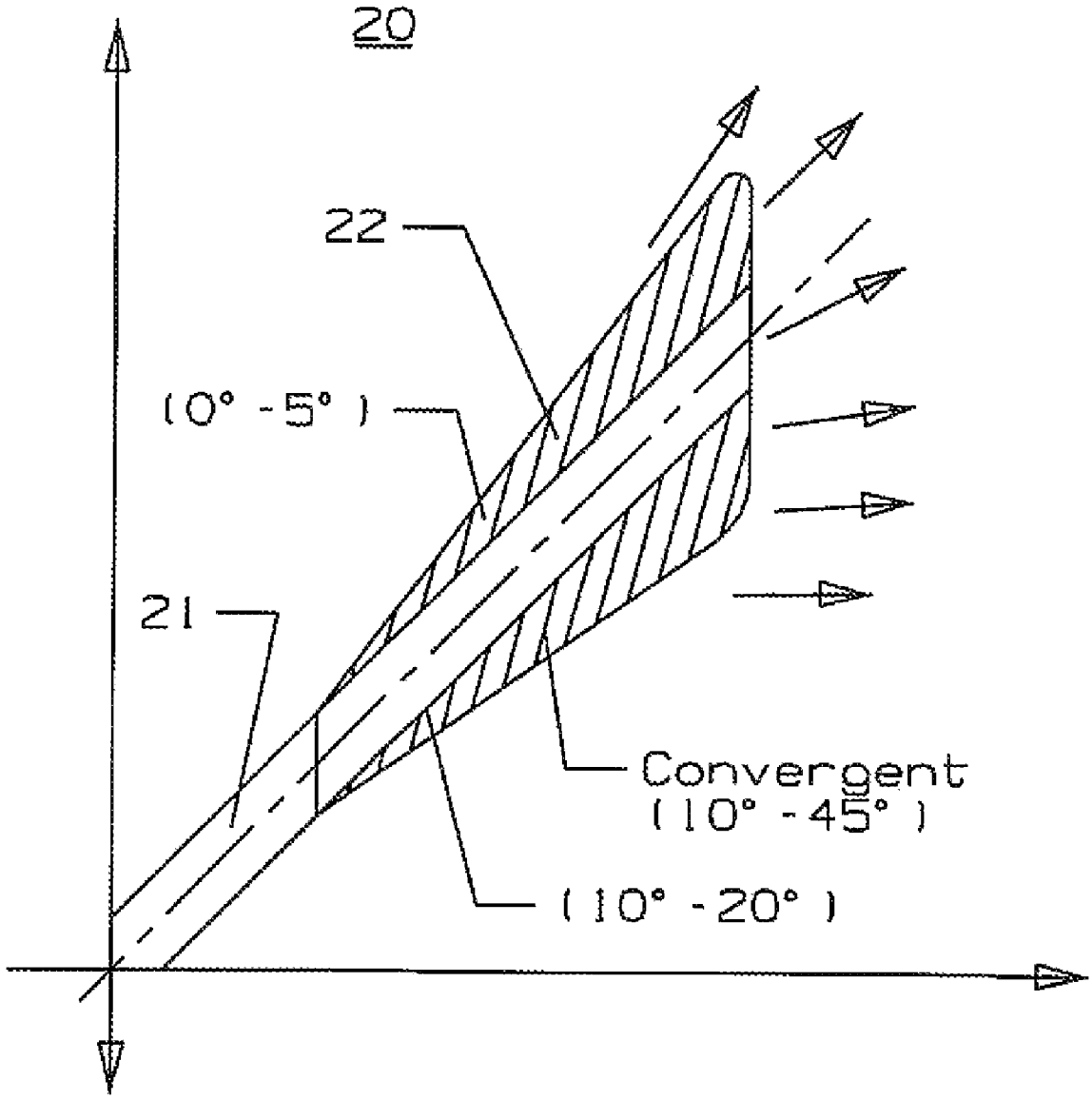
FIG. 5 shows a cross section top view of the film cooling hole of the present invention in a compound orientation.

FIG. 5 shows a second embodiment of the film cooling hole of the present invention in which the film hole 20 is a compound film hole that also have the two side walls that have around 10 degrees diffusion but also slant downward from 10 degrees to 45 degrees as in the first embodiment. The film hole 20 includes a metering section 21 and the diffusion section 22 in which the two side walls also have a slant toward the lower or downstream wall as well as the 10 degree diffusion.

For the streamwise shaped film cooling hole (first embodiment FIG. 4) application, the multiple expansion is defined as 10 degrees downstream and 10 degrees in the radial outward and radial inward directions for the cooling hole. However, the sidewalls in the radial expansion direction are angled at a convergent angle of from 10 degrees to 45 degrees inward. This forms a trapezoid shaped diffuser with a smaller opening on the hot or upstream side next to the mainstream and wider open next to the blade surface.

For the compound shaped film cooling hole of FIG. 5, the multiple expansion is defined as 10 degrees downstream and 0 to 5 degrees in the radial outward direction. The side wall in the radial expansion direction will be at the convergent angle of 10 to 45 degrees. However, for the cooling hole in the radial inward direction the expansion angle is in the range of 10 to 20 degrees and with a convergent sidewall angle of 10 to 45 degrees. With this unique film cooling hole shape, an even larger film cooling hole breakout and foot print in achieved over the cited prior art film holes, and thus a better film coverage with bettor film cooling is produced. The convergent inner sidewall reduces the film hole hot gas side breakout and thus allows for the film cooling flow to be distributed more at the inner surface of the film cooling hole better. Shear mixing with the hot gas flow is minimized which yields a higher film effectiveness level than the cited prior art film holes.

I claim the following:

1. A film cooling hole for use on an airfoil surface of a gas turbine engine in which the airfoil surface is exposed to a hot gas flow, the film cooling hole comprising:

a metering section having a constant diameter cross section;

a diffusion section having two side walls that produce a diffusion along the side walls, and the two side walls also being slanted toward the downstream wall.

2. The film cooling hole of claim 1, and further comprising:

the diffusion section has a trapezoid cross sectional shape with a smaller opening on the upstream wall side and a wider opening on the downstream wall side.

3. The film cooling hole of claim 2, and further comprising:

the two side walls and the downstream wall produce a diffusion of around 10 degrees; and, the two side walls are also angled at a convergent angle of from around 10 degrees to around 45 degrees inward.

4. The film cooling hole of claim 3, and further comprising:

the film cooling hole is a streamwise shaped film cooling hole.

5. The film cooling hole of claim 1, and further comprising:

the film cooling hole is a compound shaped film cooling hole.

6. The film cooling hole of claim 5, and further comprising:

a multiple expansion of around 10 degrees in the downstream direction and 0 to 5 degrees in the radial outward direction.

7. The film cooling hole of claim 6, and further comprising:

the side wall in the radial expansion direction have a convergent angle of from 10 to 45 degrees.

8. The film cooling hole of claim 7, and further comprising:

the cooling hole in the radial inward direction has an expansion angle of from 10 to 20 degrees with a convergent sidewall angle of 10 to 45 degrees.

9. An air cooled turbine airfoil for use in a gas turbine engine, the airfoil comprising:

an airfoil wall to be exposed to a hot gas flow through the turbine section of the gas turbine engine;

a film cooling hole having a metering section and a diffusion section;

the diffusion section having a multiple expansion in the two sidewalls and the downstream wall; and, the two side walls of the diffusion section in a radial expansion direction are angled at a convergent angle of from 10 to 45 degrees inward.

10. The air cooled turbine airfoil of claim 9, and further comprising:

the diffusion section includes radial inward and radial outward expansion of around 10 degrees.

11. The air cooled turbine airfoil of claim 9, and further comprising:

the film cooling hole is a compound shaped film cooling hole with the multiple expansion including around 10 degrees on the downstream side wall and from 0 to 5 degrees in the radial outward direction.

12. The air cooled turbine airfoil of claim 11, and further comprising:

the side wall in the radial expansion direction has a convergent angle of from 10 to 45 degrees.

13. The air cooled turbine airfoil of claim 12, and further comprising:

the diffusion section in the radial inward direction has an expansion angle of from 10 to 20 degrees and a convergent side wall angle of from 10 to 45 degrees.

* * * * *